United States Patent [19]

Graffin

[11] Patent Number: 4,635,688

[45] Date of Patent: Jan. 13, 1987

[54] METHOD AND APPARATUS FOR MONITORING AND CONTROLLING PRODUCTION LINE FILLING OF RECEPTACLES WITH A PREDETERMINED WEIGHT OF VARIABLE DENSITY MATERIAL

[75] Inventor: Andre J. J. Graffin, La Ferte Bernard, France

[73] Assignee: Etablissements A. Bertaud, Vitrolles, France

[21] Appl. No.: 671,667

[22] Filed: Nov. 15, 1984

[30] Foreign Application Priority Data

Nov. 18, 1983 [FR] France ..... 83 18417

[51] Int. Cl.[4] ..... B67C 3/26

[52] U.S. Cl. ..... 141/1; 141/83; 141/266; 141/146; 141/147; 177/1

[58] Field of Search ..... 177/58, 25, 1; 141/83, 141/1, 98, 129, 144–152, 167, 181–183, 188, 250, 255, 258, 259, 392, 266, 128

[56] References Cited

U.S. PATENT DOCUMENTS

| | | | |
|---|---|---|---|
| 1,726,297 | 8/1929 | Hansen | 141/146 X |
| 2,280,614 | 4/1942 | Ayars | 177/50 |
| 2,321,994 | 6/1943 | Chapman | 141/146 |
| 2,961,013 | 11/1960 | Johnson | 141/1 |
| 3,189,062 | 6/1965 | Kazmierczak | 141/147 |
| 3,240,146 | 3/1966 | Schreuder et al. | 141/83 X |
| 3,570,558 | 3/1971 | Lachaussee | 141/140 |
| 3,955,243 | 5/1976 | Binder | 141/83 X |
| 4,060,106 | 11/1977 | Takasuga | 141/1 |
| 4,060,109 | 11/1977 | Sotama | 141/83 |
| 4,244,404 | 1/1981 | Brockner | 141/146 |
| 4,337,802 | 7/1982 | Kennedy et al. | 141/1 |
| 4,446,674 | 5/1984 | Inada | 141/128 X |

FOREIGN PATENT DOCUMENTS

| | | | |
|---|---|---|---|
| 1023469 | 3/1966 | United Kingdom | 141/146 |

*Primary Examiner*—Stephen Marcos
*Assistant Examiner*—Ernest G. Cusick
*Attorney, Agent, or Firm*—Sughrue, Mion, Zinn, Macpeak and Seas

[57] ABSTRACT

Each filling station comprises a balance (36) and a piston and cylinder volumetric dispenser (37). The piston rod (33) is actuated by a cam (34) which optionally includes a portion (341) which is adjustable. Resilient means (40) are interposed between the cam and the piston. While a receptacle (39) is engaged in a filling station the following operations take place in succession: the empty receptacle is weighed and at the same time the volumetric dispenser is filled with slightly more material than is to be dispensed; the material in the volumetric dispenser (37) is then transferred to the receptacle (39) and the receptacle is continuously weighed until it has received the set weight of material. The outlet from the dispenser is then closed, thus jamming its piston before it reaches the end of its stroke. The resulting forces are absorbed by the resilient means. Optionally, the amount material which is admitted to the dispenser prior to each filling operation is adjusted by acting on the said adjustable portion of the cam, to ensure that receptacle filling is stopped in the vicinity of a predetermined point on the cam or of the piston stroke.

6 Claims, 6 Drawing Figures

METHOD AND APPARATUS FOR MONITORING AND CONTROLLING PRODUCTION LINE FILLING OF RECEPTACLES WITH A PREDETERMINED WEIGHT OF VARIABLE DENSITY MATERIAL

BACKGROUND OF THE INVENTION

The present invention relates to a method and to apparatus for monitoring and controlling production line filling of receptacles with a predetermined weight of a variable density material.

In many industries, e.g. in food, oil, pharmaceuticals, or chemistry, there is a need to package liquid or pasty materials which are of variable density. In homogeneous materials, such density variation may simply be due to temperature expansion or contraction, while in some heterogeneous materials density variation is a specific feature of the material. In either case, there is a problem when a production line of receptacles is to be filled with a predetermined fixed weight of the material.

If conventional fixed volume filler apparatus is used, it is necessary to set the filling apparatus to fill the receptacles with too much material as a general rule, so that the minimum weight is guaranteed even under worst case conditions, i.e. when the material is at its lowest density.

Such systematic overfilling of the receptacles to guarantee a minimum weight represents a direct loss to the manufacturer of the material, since the filling errors are cumulative and not in the manufacturer's favor. The cumulative overfill of un-payed-for material shipped to the customer may be far from negligible.

It is also possible to use filling installations that use an inbuilt balance to produce a constant weight fill by weighing each receptacle individually. This does at least eliminate problems due to varying density. However, in practice there are several difficulties. Firstly, accurate weighing requires a certain minimum settling time. Unfortunately this settling time is longer than the time needed to fill the receptacle, particularly on high throughput filling installations such as are used for filling jam jars, for example. (Since jam jars have a wide opening they can be filled very fast). Additionally, some receptacles, particularly those made of glass, do not all weigh exactly the same as one another, so the weighing operation must be performed twice for each receptacle, once when empty to determine the weight of the receptacle, and then again when full to measure the weight of the material with which it has been filled. This requires at least two settling periods. Clearly such double weighing could be avoided by systematically overfilling to make allowance for the worst expected variation in receptacle weight, but that negates the advantage which weighing is supposed to bring over volumetric filling. Thus, filling installations that weigh the material either require the throughput of the production line to be reduced to less than the throughput which can be achieved by volumetric filling, or else the throughput can be kept up, but only at the expense of the weighing operation becoming somewhat approximate in which case it is again necessary to overfill the receptacles by enough to make up for expected errors of approximation. Thus, presently available filler installations which include a weighing step are not completely satisfactory since they lead either to a loss of time or else to a loss of material—and in either case that means a loss of income for the manufacturer.

Preferred implementations of the present invention mitigate these drawbacks.

SUMMARY OF THE INVENTION

The present invention provides a method of monitoring and controlling the filling of receptacles placed in succession in a filling installation which includes a rotary carrousel type member having a plurality of filling stations each of which receives a receptacle for filling with a desired set weight of material, the method comprising the following steps:

a volumetric dispenser associated with each station receives a volume of the material such that its weight is slightly higher than the set weight;

the material contained in the volumetric dispenser associated with each station is transferred from the said volumetric dispenser to a receptacle under the control of a control unit, with resilient means being interposed;

each receptacle engaged in a filling station is weighed empty, and then while being filled by a balance that moves with each filling station;

during filling, the weight contained in each receptacles is continuously compared with the set weight;

the filling of each receptacle is stopped by closing an outlet orifice from the volumetric dispenser when the weight of its contents reaches the set weight; and the abnormal forces resulting from closure of the outlet orifice from the volumetric dispenser before the total volume of the material intially inserted therein has been dispensed are taken up by the said resilient means disposed between the control unit and the volumetric dispenser.

Preferably the rate of filling is relatively high during a first phase, and then falls off to become relatively low during a second phase, the first phase being of predetermined duration, with the position at which receptacle filling is stopped on the filling path being used, if necessary, to modify the volume of the material which is inserted into the filling station's volumetric dispenser prior to filling a subsequent receptacle in such a manner as to ensure that the filling of the subsequent receptacle is stopped during the phase when the filling is slow.

To implement the above-defined method, the invention also provides apparatus such that:

each filling station includes a volumetric dispenser for receiving a predetermined volume of material to be dispensed on a first path of the carrousel, and for transferring a portion of said volume into a receptacle on a second path of the carrousel;

each filling station includes a balance which moves with the station to continuously weigh a receptacle before and during filling;

the installation includes a control unit for controlling the filling of each volumetric dispenser during a first path of the carrousel and the transfer of a portion of its contents into a receptacle during the second path of the carrousel;

the installation includes calculating and storing means for weighing an empty receptacle, for continuously comparing the weight of the receptacle with the set value, and for stopping filling when the weight contained in the receptacle reaches the said set value; and each station includes resilient means interposed between the control unit and the volumetric dispenser to take up the abnormal forces which result from closing the outlet orifice of the said volumetric dispenser before the total volume of material initially inserted therein has been dispensed.

Preferably, the apparatus concerns a filling installation in which the control unit includes means for controlling the transfer of the material from the volumetric dispenser to the receptacle initially at a relatively high speed on a first portion of the second path of the carrousel, and then at a relatively low speed on a second portion of the second path of the carrousel, the apparatus further including means for acting on the control unit as a function of the point at which receptacle filling stopped on the second portion of the second path of the carrousel.

BRIEF DESCRIPTION OF THE DRAWINGS

An embodiment of the invention is described by way of example with reference to the accompanying drawings, in which.

DETAILED DESCRIPTION OF THE PREFERRED EMBODIMENTS

Figure 1:
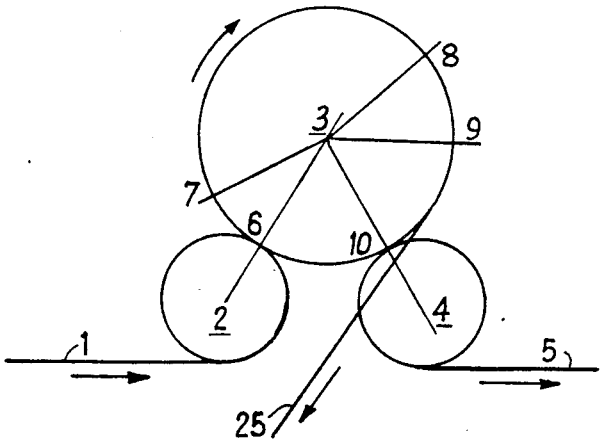
FIG. 1 is a diagrammatic plan view of a filling installation including a rotary carrousel type member, on which the various phases are shown of the path of a receptacle or of a filling station.

FIG. 1 shows the different stages of the path of a receptacle round a production line filling installation including a rotary carrousel 3 fitted with several filling stations. The receptacle is conveyed by means of a conveyor 1 to a distributer star 2 which inserts it at point 6 into one of the filling stations on the rotating carrousel 3. Between points 6 and 7 the receptacle is weighed empty, its weight being stored in a calculating and storage unit 60 (FIG. 4), and at the same time filling of the volumetric dispenser which began at 10 comes to an end. Between points 7 and 8, a portion of the volume of the material contained in the volumetric dispenser is transferred at high speed into the receptacle. Between points 8 and 9, the transfer of material continues, but at slower speed and until the receptacle contains the desired weight of material. Between point 7 and the point at which filling stops (which point is arranged to be somewhere on the slow filling path between points 8 and 9) the receptacle is continuously weighed. The calculating and storage unit 60, e.g. a microprocessor, continuously compares the weight of the material contained in the receptacle with the desired weight, and when the desired weight is reached, it causes receptacle filling to be stopped. The filled receptacle then leaves the carrousel 3, either tangentially thereto on conveyor means 25, or else in a preferred direction, e.g. parallel to the conveyor 1, by means of a second distributer star 4 leading to a conveyor 5.

Figure 2:
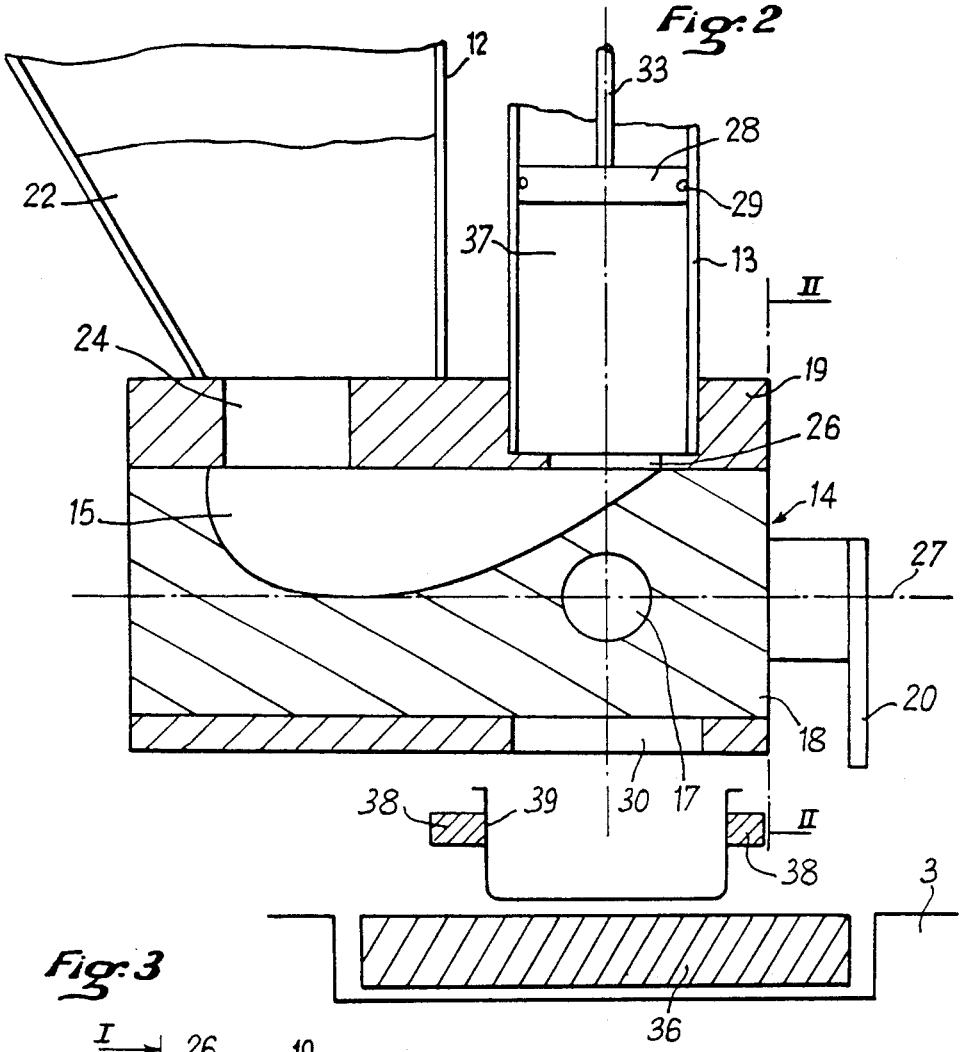
FIG. 2 is a diagrammatic section view of an embodiment of a filling station.
Figure 3:
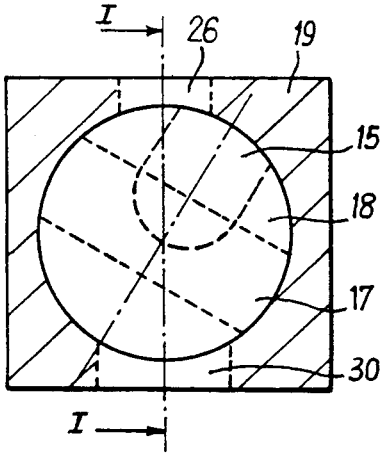
FIG. 3 is a diagrammatic section view on a line II—II in FIG. 2, with the volumetric dispenser's feed hopper being omitted.

FIG. 2 is a diagrammatic section through an embodiment of a filling station. Each filling station is situated on the rotary carrousel and comprises: an electronic balance 36; means 38 for centering a receptacle 39; a feed hopper 12 for material to be packaged; a volumetric dispenser 37 comprising a piston 28 fitted with sealing means 29, a cylinder 13 in which the piston 28 slides, and a rod 33 for actuating the piston 28; and a tap 14 comprising a body 19 and a cylindrical plug 18 mounted to rotate in the body 19.

The body 19 has: a horizontal axis 27; a vertical duct 24 through the upper wall of the body placed to receive material downwardly from the hopper 12; a vertical duct 26 through the upper wall of the body placed immediately below the volumetric dispenser 37; a countersunk upper portion to the volumetric dispenser duct 26 for receiving the dispenser cylinder 13; and a vertical duct 30 through the lower wall of the body and on the same axis as the dispenser duct 26.

The cylindrical plug 18 fills the bore of the body 19 and is free to rotate about the axis 27. It includes: a hollowed out portion 15 which serves, in a predetermined position of the plug relative to the body, to put the hopper duct 24 into communication with the dispenser duct 26; a dispensing duct 17 which is not in communication with the hollowed out portion 15 and which serves, in a different predetermined position of the plug relative to the body, to put the dispenser 37 in communication with the lower duct 30 through the body 19; and a control lever 20 by which the plug 18 may be rotated relative to the body 19. Suitable actuator means 61 (FIG. 4) which may be electrically, pneumatically or otherwise driven, act on the lever 20 on instructions from the calculating and storage unit 60.

When a filling station is between the points 10 and 7 shown in FIG. 1, the plug 18 is placed as shown in FIG. 2 so that the hollowed out portion 15 puts the hopper into communication with the dispenser. When a filling station is between the point 7 and the point somewhere between the points 8 and 9 at which filling is stopped, the plug 18 is placed so that the duct 17 is aligned with the ducts 26 and 30, thereby putting the volumetric dispenser in communication with a receptacle 39.

Figure 4:
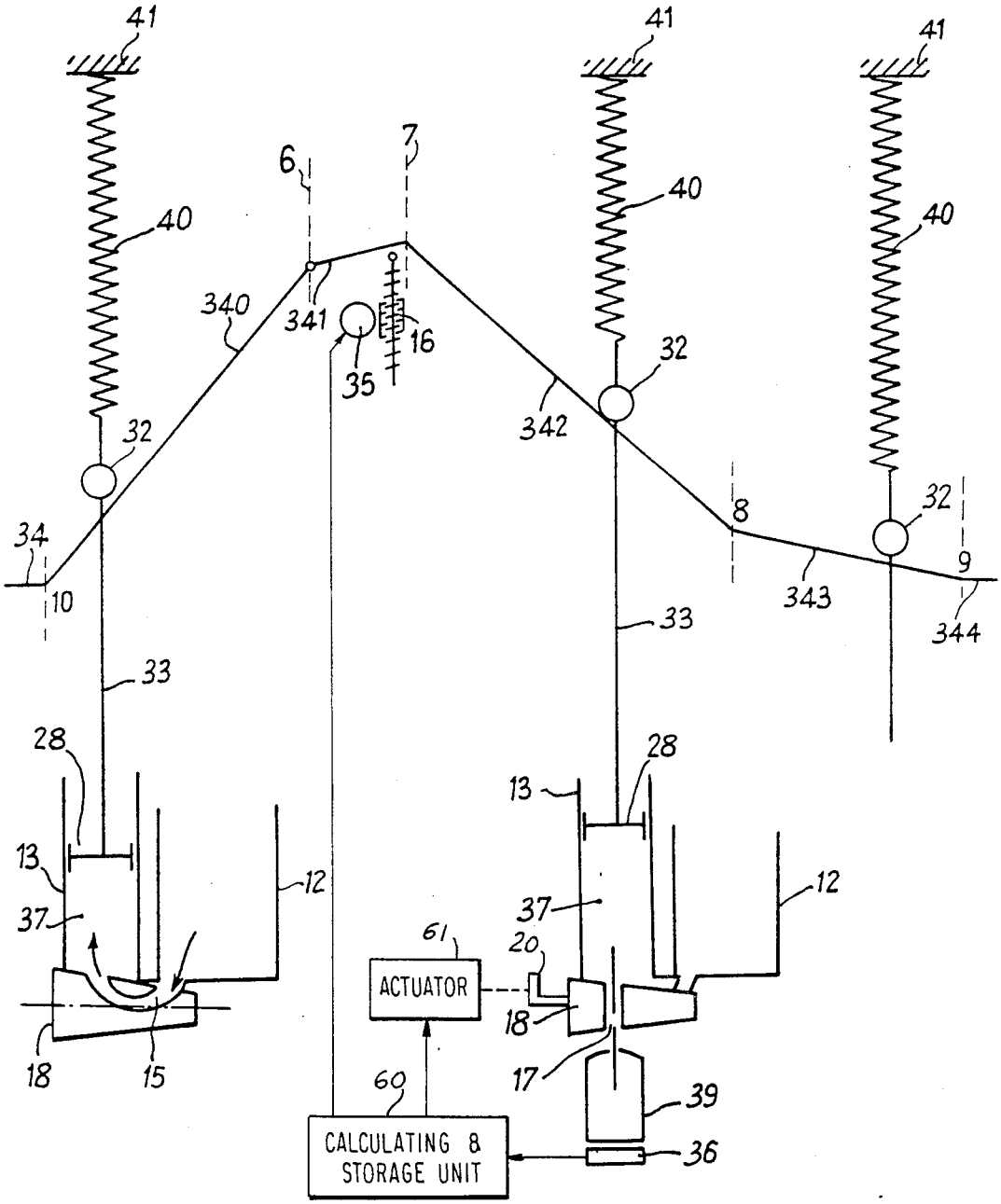
FIG. 4 is a diagram showing a development of a cam and two filling stations, the left hand filling station being shown on the first path of the cam and the right hand filling station on the second path of the cam.

FIG. 4 is a diagrammatic development of a cam showing the cam controlling operation of two filling stations. It must be understood that in practice this cam is not developed as shown, but rather is wrapped round the periphery of a cylinder having the same axis as the carrousel. Further it should be understood that it may control as many filling stations as is convenient, which, in practice, will normally be more than two.

The cam 34 represented in FIG. 4 has a rising ramp with two successive slopes: ramp 340 from points 10 to 6, and ramp 341 between points 6 and 7. It then has a falling ramp with two different slopes: a ramp 342 between points 7 and 8, and a ramp 343 between points 8 and 9. Finally there is a horizontal portion 344 between points 9 and 10. The points are numbered as in FIG. 1. The rising path corresponds to the volumetric dispenser 37 being filled. The falling path corresponds in part to the material being transferred from the volumetric dispenser 37 to the receptacle 39.

The cam 34 is fixed relative to the rotation of the carrousel 3 on which the filling stations are mounted. It controls the operation of each filling station by guiding a cam-follower wheel 32 which is fixed to the piston rod 33. Resilient means 40 exert a force between the end of each rod 33 and a vertically fixed point 41 on the carrousel. The resilient means 40 act in compression and keep the wheels 32 in contact with the cam 34, thereby ensuring that the wheels follow the falling portions of the cam. They also have a second function. When the calculation and storage unit 60 determines that receptacle filling should stop, it stops the filling by closing the tap 14. If the cam follower wheel 32 were constrained to follow the cam all the way down, eg. by a rail running parallel to the cam 34, then the dispensers would be damaged. As it is, the resilient force exerted by the means 40 is designed to be sufficient to overcome the resistance of material as it is dispensed through the ducts 26, 17 and 30, but less than the resistance applied to the piston 28 when the tap 14 is closed, so that the unused portion of the piston stroke is absorbed by the resilient means 40 after the tap is closed and with some excess product remaining in the dispenser. The wheel 32 looses contact with the falling ramp at the point where filling stops, and regains contact at the point on the rising ramp of the cam which is at the same level. Finally, the resilient means 40 constitute a safety margin in the event of some kinds of jamming. Since the cam-follower wheel can leave the cam if necessary, many kinds of possible damage are avoided.

In a variant of the present invention, the filling of the volumetric dispenser 37 may be modified so that the stopping point when filling a receptacle 39 takes place between points 8 and 9, i.e. on the falling ramp 343 at a moment when the rate of filling is slow. FIG. 4 shows a device for enabling the volume of material admitted to the volumetric dispenser to be varied. The device is constituted by a portion of the rising ramp 341 of the cam 34 whose slope may be adjusted by means of a motor and reduction gear unit 35 driving an endless screw 16. When the installation is started up the slope of the ramp 341 is adjusted so that the filling stop point is between points 8 and 9. The calculating and storage unit 60 stores the coordinates of the filling stop point and verifies that it lies on a portion of the ramp 343. If for any reason the stop point begins to drift and approach either the point 8 or the point 9 by more than some tolerated amount of drift, the calculating and storage unit modifies the slope of the portion of the ramp 341 in such a direction as to tend to return the stop point to the middle of the allowed range.

Figure 5:
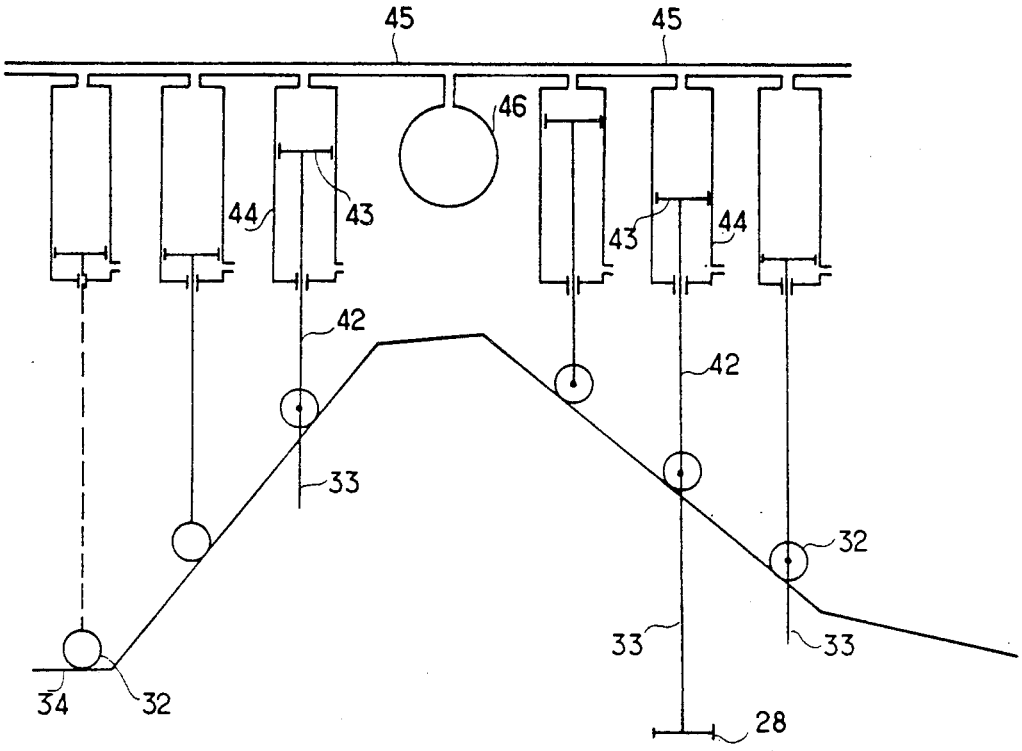
FIG. 5 is a diagram showing a development of the cam and a plurality of pneumatic actuators interposed between the said cam and the volumetric dispensers (not shown in this figure), the actuators being interconnected by a channel leading to a buffer volume.

FIG. 5 shows a particular example of the resilient means interposed between the cam 34 and the rod 33 of the piston of each volumetric dispenser. The resilient means used in this example are constituted by a pneumatic actuator comprising a cylinder 44 which is fixed to the carrousel 3, a piston 43 slidably mounted in the cylinder 44, and a rod 42 which has one end fixed to the piston 43 and its other end fixed to a cam-follower wheel 32. The pneumatic actuators of all the filling stations are connected to one another and also to a buffer volume 46 by means of a duct 45.

Figure 6:
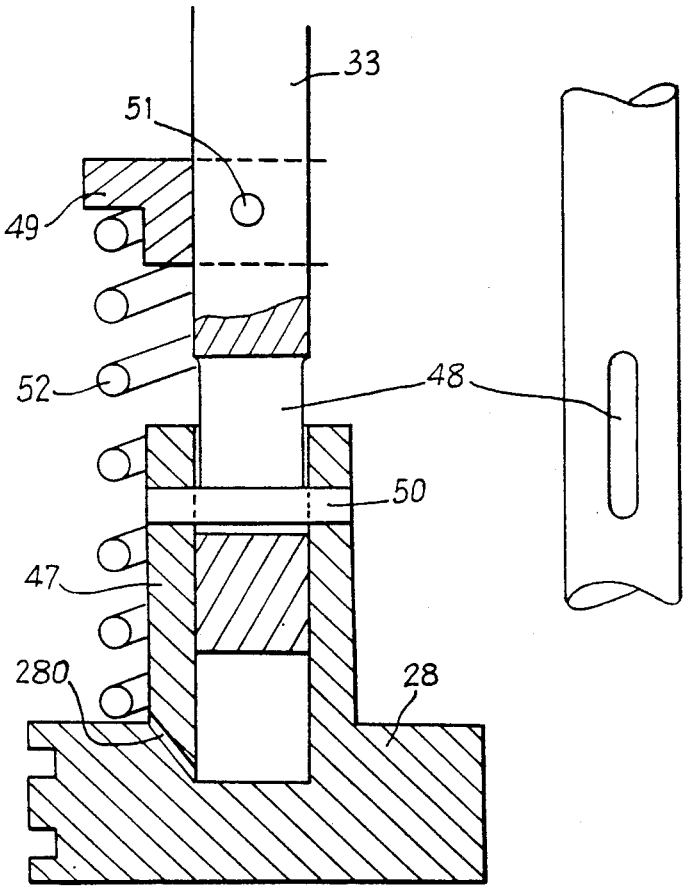
FIG. 6 is a section through an example of the resilient means interposed between the cam and a volumetric dispenser.

FIG. 6 is a section through another example of resilient means interposed between the cam 34 and the rod 33 of the piston in each volumetric dispenser. The piston 28 of the volumetric dispenser 37 is surmounted by a cylindrical portion 47 having a bore for guiding the end of the rod 33. The rod 33 includes a vertical slot 48. The slotted end of the rod is inserted in the bore of the cylindrical portion 47 in which it is free to slide vertically between two end positions defined by a horizontal pin 50 engaged in the vertical slot 48. In addition, a ring 49 is fitted to the rod 33 by a second pin 51. The ring has a shoulder in which it receives a compression spring 52 acting between the piston 28 and the ring to urge the rod 33 away from the piston. The spring 52 is mounted around the rod 33. This arrangement of resilient means is compatible with the use of a rail running parallel to the cam 34 and thus constraining the cam-follower wheel to follow the cam at all times.

I claim:

1. A method of filling receptacles (39) with a net reference value weight of a product in a filling installation which includes a rotary carrousel (3) having a plurality of filling stations, said method comprising the steps of:

(a) successively and individually introducing the receptacles on a filling station, (b) weighing each receptacle while it is still empty, (c) simultaneously with step (b), filling a corresponding product charging mechanism of a volumetric dispenser (37) including a transfer member (28) for positively moving said product, with an excess weight of product higher than said net reference value weight, (d) filling each receptacle by continuously moving said transfer member so that product is transferred from said volumetric dispenser into a corresponding receptacle, (e) simultaneously with step (d), continuously weighing said receptacle and comparing an instantaneous net weight of the product in the receptacle with said net reference value weight, (f) interrupting said transfer and attendantly halting the movement of the transfer member as soon as the net weight in the receptacle is equal to said net reference value weight such that said excess weight of product remains in said charging mechanism, and (g) resiliently absorbing lost further motion of the transfer member attendant with the halting thereof.

2. A receptacle filling installation, comprising: a rotary carrousel, a plurality of filling stations on said carrousel each comprising a product feed hopper (12), a volumetric dispenser charging mechanism (37) having a transfer member (28) for positively applying a pressure on product contained in said charging mechanism, said transfer member (28) being connected to an actuating member (32) for moving said transfer member, a tap member (14) movable between a first position in which it closes an outlet (30) of said charging mechanism and a second position in which it establishes a connection with said outlet (30), a receptacle weighing balance (36) positioned beneath said outlet, and actuator means (61) for controlling the position of said tap member; said installation further comprising a calculating and storage unit (60) having an input connected to the weighing balance of each filling station and an output connected to the respective actuator means (61); each of said filling stations further comprising means (40, 44, 52) for resiliently absorbing lost further motion movements of said transfer member upon closure of an associated tap member with an excess of product remaining in said charging mechanism.

3. A filling installation according to claim 2, wherein each charging mechanism comprises a cylinder (13), said transfer member comprises a piston (28) movable in said cylinder, and said actuating member comprises a cam follower (32) connected to an outer end of a rod of said piston, and further comprising a cam (34) for guiding said cam follower.

4. A filling installation according to claim 3, wherein said means for resiliently absorbing lost motion movements comprise springs (40) biasing said cam followers (32) toward said cam (34).

5. A filling installation according to claim 3, wherein said means for resiliently absorbing lost motion movements comprise pneumatic actuators biasing said cam followers (32) toward said cam (34).

6. A filling installation according to claim 3, wherein said means for resiliently absorbing lost motion movements comprise springs (52) mounted on said piston rods (33) and acting at one end on a ring (49) secured to said piston rods and at an other end on said pistons (28), said piston rods being connected to said pistons by horizontal pins (50) engaged in vertical slots (48) of said piston rods.

* * * * *